US008931781B2

(12) United States Patent
Dreiband

(10) Patent No.: US 8,931,781 B2
(45) Date of Patent: Jan. 13, 2015

(54) ROUND ABSORBING AIRSOFT TARGET TRAP ASSEMBLY

(71) Applicant: Daniel Isaac Dreiband, Hampstead, MD (US)

(72) Inventor: Daniel Isaac Dreiband, Hampstead, MD (US)

( * ) Notice: Subject to any disclaimer, the term of this patent is extended or adjusted under 35 U.S.C. 154(b) by 56 days.

(21) Appl. No.: 13/723,442

(22) Filed: Dec. 21, 2012

(65) Prior Publication Data

US 2013/0187336 A1 Jul. 25, 2013

Related U.S. Application Data

(60) Provisional application No. 61/580,247, filed on Dec. 25, 2011.

(51) Int. Cl.
*F41J 13/02* (2009.01)

(52) U.S. Cl.
CPC ..... *F41J 13/02* (2013.01)
USPC ..... 273/404; 273/410

(58) Field of Classification Search
USPC ..... 273/403–410, 398–402
See application file for complete search history.

(56) References Cited

U.S. PATENT DOCUMENTS

| | | | | | |
|---|---|---|---|---|---|
| 841,611 | A | | 1/1907 | Alsop | |
| 1,371,867 | A | * | 3/1921 | Dean | 273/397 |
| 1,886,562 | A | * | 11/1932 | Lefever | 273/382 |
| 2,397,921 | A | | 4/1946 | Cole | |
| 2,535,280 | A | | 12/1950 | Gartrell | |
| 2,691,526 | A | * | 10/1954 | Wesley et al. | 273/359 |
| 2,901,254 | A | | 8/1957 | Fortson | |
| 2,815,955 | A | | 12/1957 | Dear | |
| 2,827,297 | A | * | 3/1958 | Foster | 273/401 |
| 2,895,737 | A | * | 7/1959 | Blees | 473/478 |
| 3,122,367 | A | | 2/1964 | Dale | |
| 3,455,554 | A | | 10/1965 | Rademacher | |
| 3,319,960 | A | | 5/1967 | Wilcox | |
| 3,477,724 | A | * | 11/1969 | Wilcox | 273/404 |
| 3,495,829 | A | * | 2/1970 | Booth | 273/371 |
| 3,817,528 | A | * | 6/1974 | Stuhler | 273/393 |
| 3,982,761 | A | * | 9/1976 | DeVogelaere | 273/410 |
| 4,066,262 | A | * | 1/1978 | Stiefel | 273/400 |
| 4,470,604 | A | * | 9/1984 | Hoffmann | 273/404 |
| 4,546,984 | A | * | 10/1985 | Towle et al. | 273/404 |
| 4,583,744 | A | | 4/1986 | Tolliver et al. | |
| 4,744,568 | A | | 5/1988 | Bernahl et al. | |
| 4,821,620 | A | | 4/1989 | Cartee et al. | |
| D329,680 | S | | 9/1992 | Burn | |
| 5,280,919 | A | * | 1/1994 | Graham | 273/381 |
| 5,988,647 | A | | 11/1999 | Porter et al. | |
| 6,189,889 | B1 | * | 2/2001 | Yip | 273/348 |
| 6,997,825 | B2 | * | 2/2006 | Girard et al. | 473/466 |
| 7,434,810 | B2 | | 10/2008 | DeMille et al. | |
| 7,494,128 | B2 | * | 2/2009 | Byram et al. | 273/404 |
| 8,608,170 | B2 | * | 12/2013 | Ball | 273/407 |
| 2008/0023916 | A1 | | 1/2008 | Remillard | |
| 2009/0008878 | A1 | * | 1/2009 | Jones | 273/404 |
| 2010/0090407 | A1 | * | 4/2010 | Lin | 273/371 |
| 2011/0037227 | A1 | | 2/2011 | O'Neal et al. | |
| 2011/0227288 | A1 | | 9/2011 | Krickovic | |

* cited by examiner

*Primary Examiner* — Mark Graham
(74) *Attorney, Agent, or Firm* — Berenato & White, LLC

(57) ABSTRACT

A round absorbing Airsoft target trap assembly is provided that includes a target frame and a backstop for receiving and reducing the velocity of Airsoft rounds passing through the target frame.

21 Claims, 9 Drawing Sheets

ROUND ABSORBING AIRSOFT TARGET TRAP ASSEMBLY

CROSS-REFERENCE TO RELATED APPLICATION(S) AND CLAIM OF PRIORITY

This application claims the benefit of priority of provisional application No. 61/580,247 of Daniel Isaac Dreiband filed on Dec. 25, 2011 entitled "Round Absorbing Airsoft Target (RAAT) Trap," the complete disclosure of which is incorporated herein by reference.

FIELD OF THE INVENTION

This invention relates to a round absorbing Airsoft target trap assembly, and especially to a round absorbing Airsoft target trap assembly that deflects and retains rounds fired at the assembly from all types of Airsoft guns and launchers.

BACKGROUND

Although the sport of Airsoft is not new, it has seen a tremendous increase in popularity over the past five or more years due to recent technological developments. Airsoft guns are now carried by major retail chains. One of the greatest lures to Airsoft is their realism. Other than a three-quarter inch orange muzzle mandated by law on the tip of Airsoft weapons, Airsoft weapons look and feel very much like their live ammunition, steel counterparts.

Proper handling, training, and transport are important where Airsoft safety is concerned and diligent promotion of safety habits is necessary for the future welfare of the Airsoft sport. Airsoft guns can fire rounds, typically small plastic BBs, traveling at speeds that may be exceeding 500 feet per second (fps) at a rate of 1200 rounds per minute (RPM). The initial effective range for most Airsoft guns is at least 150 feet. Consequently, missed shots may result in radically deflected ricochets that can present hazards to person and property.

Thus, it is highly desirable to provide an effective target trap that allows for flexibility of Airsoft weapons usage for training purposes and shooting sessions in controlled and safe environments. Traditional target traps designed for bullets have been around over a century. Because bullets are not re-usable, these traditional traps are constructed to not only trap the incoming bullets, but to absorb their kinetic energy by deforming the bullets against the backstops of the bullet traps. Pellets trap, similar to lead bullets targets, rely upon the deformation of the projectile upon impacting the backstop, with the newly flattened projectile being diverted into a capture area. Such bullet and pellet traps are not effective for Airsoft BBs, which do not deform upon impact with backstops of conventional bullet and pellet traps. Airsoft BBs typically will ricochet and potentially fragment against the backstops instead of deforming. A ricocheting Airsoft BB is more likely to escape the trap at high velocity, presenting a potential safety concern. Alternatively, ricocheting Airsoft BBs may collide with other Airsoft BBs previously captured in the trap, causing the Airsoft BBs to either escape the trap or to fragment into smaller projectiles that may vector in an unpredictable manner and escape the trap, making for an unsafe shooting environment.

A dedicated, self-enclosed target having a heavyweight fabric material as a backstop might be effective for lower velocity Airsoft guns. However, Airsoft gun velocity ranges in spectrum from lower end plastic Airsoft pistols shooting rounds at approximately 150 fps all the way up to hi-powered all metal Airsoft rifles shooting rounds at 600 fps. Indeed, with technological advances, it may be that even high round velocities will be reached in the future. A fabric backed Airsoft targets can only handle incoming BBs traveling velocities of 300-325 fps or lower. Many Airsoft gaming fields allow Airsoft weapons to fire up to 400 fps, making fabric-backed Airsoft targets not practical.

A cardboard backstop would address some of the problems discussed above, even with respect to higher velocity Airsoft projectiles. However, cardboard is quickly destroyed by the incoming Airsoft rounds. Thus, cardboard backstops require frequent replacement. Failure to timely replace a degraded cardboard backstop can create a risk of that the Airsoft round may penetrate through the trap and continue flight, creating a safety risk to persons and property located behind the trap. Also, frequent replacement of the cardboard backstop, in addition to being laborious, can be quite expensive.

SUMMARY OF THE INVENTION

According to a first aspect of the invention, a round absorbing Airsoft target trap assembly is provided featuring a target frame and a backstop pivotally connected to the target frame to permit adjustment of an angle of inclination between the backstop and the target frame.

A second aspect of the invention provides a round absorbing Airsoft target trap assembly featuring a target frame and a low density polyethylene backstop positioned to receive Airsoft rounds passing through the target frame.

A third aspect of the invention provides a round absorbing Airsoft target trap assembly featuring a target frame, a backstop positioned behind of the target frame to receive Airsoft rounds passing through the target frame, and a collection bin positioned below the target frame and the backstop for receiving the Airsoft rounds after having passed through the target frame and collided with the backstop. The collection bin includes a forward portion with a substantially horizontally extending lip barrier in front of the target frame.

Other aspects of the invention, including other assemblies, apparatus, devices, sub-assemblies, kits, methods, processes, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF THE EXEMPLARY EMBODIMENTS AND EXEMPLARY METHODS

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 1:
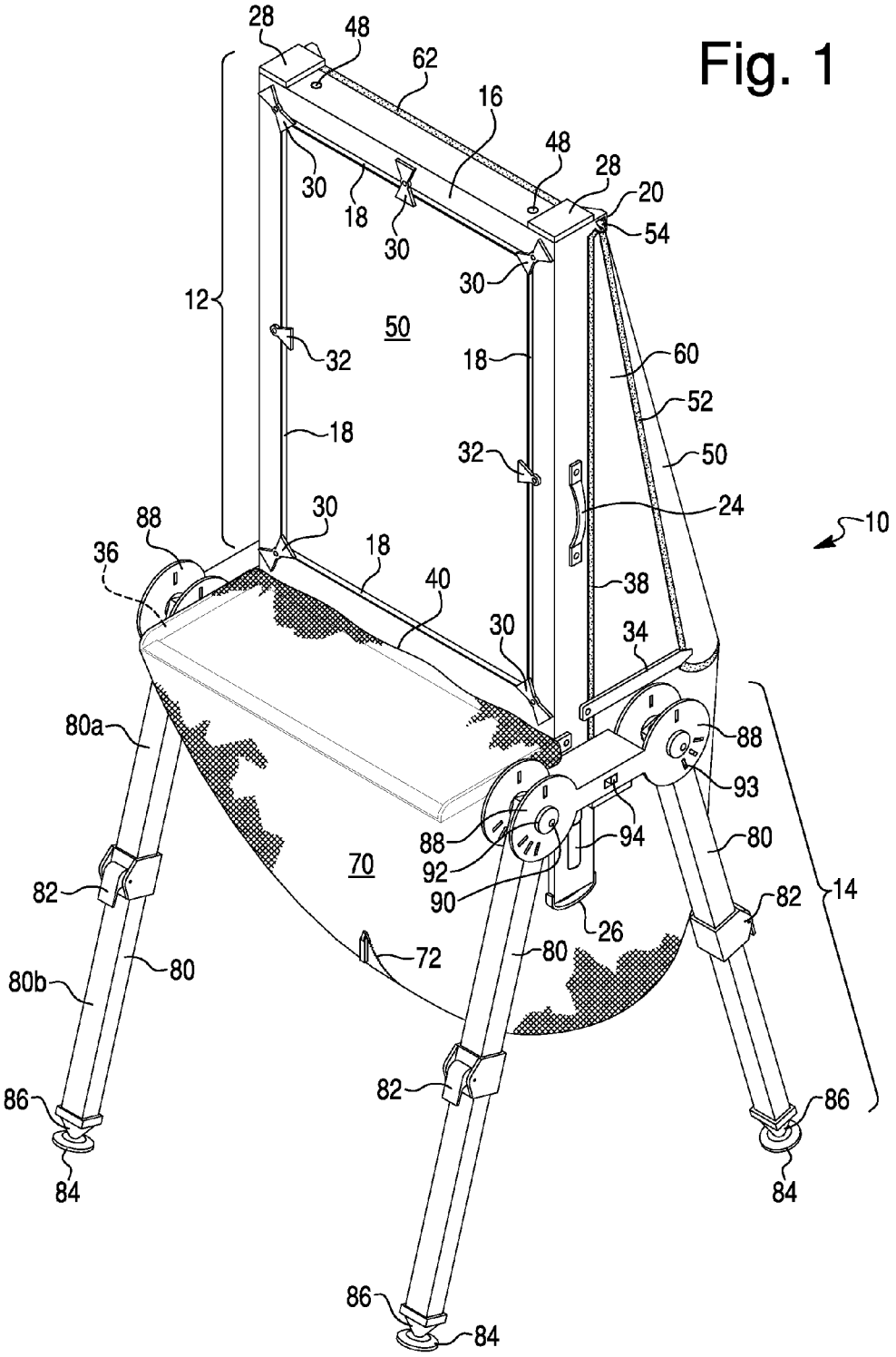
FIG. 1 is a front perspective view of a round absorbing Airsoft target trap assembly of an exemplary embodiment utilizing an adjustable and collapsible base unit structure.

Referring now more particularly to the drawings, a round absorbing Airsoft target trap assembly of an exemplary embodiment utilizing an adjustable and collapsible base unit structure is generally designated by reference numeral 10 in FIG. 1. The round absorbing Airsoft target trap assembly 10 includes an upper target trap device generally designated by reference numeral 12 and a lower support base (or stand) generally designated by reference numeral 14. The target trap device 12 and the lower support base 14 are attached to one another, as described in further detail below.

The target trap device 12 includes a target frame 16 for holding a target, such as a paper target (99 in FIG. 8), at which Airsoft rounds may be fired. The target frame 16 can be constructed of a lightweight metal alloy, plastic or other polymer, composite material, or any combination thereof. The material from which the target frame 16 is made preferably will not be worn away or structurally compromised by the impact of incoming Airsoft rounds. The target frame 16 may have a box-channel cross-sectional structure for added stability. Alternatively, the target frame 16 may have an L-shaped or T-shaped sectional structure or other structure sufficient to provide the target frame 16 with adequate stability and weight bearing capability. The construction of the target frame 16 may be determined by balancing strength-versus-weight considerations. The box-channel sectional structure has a relatively light weight, is cost effective, and has excellent strength and durability. The structure, style, size, and girth of the structural materials for the target frame 16 may be selected based on the weight the target frame 16 will be supporting and the stress the target frame 16 will endure through use, with the optional object of keeping the target trap device 12 as compact and light as possible while still providing durability.

Figure 2:
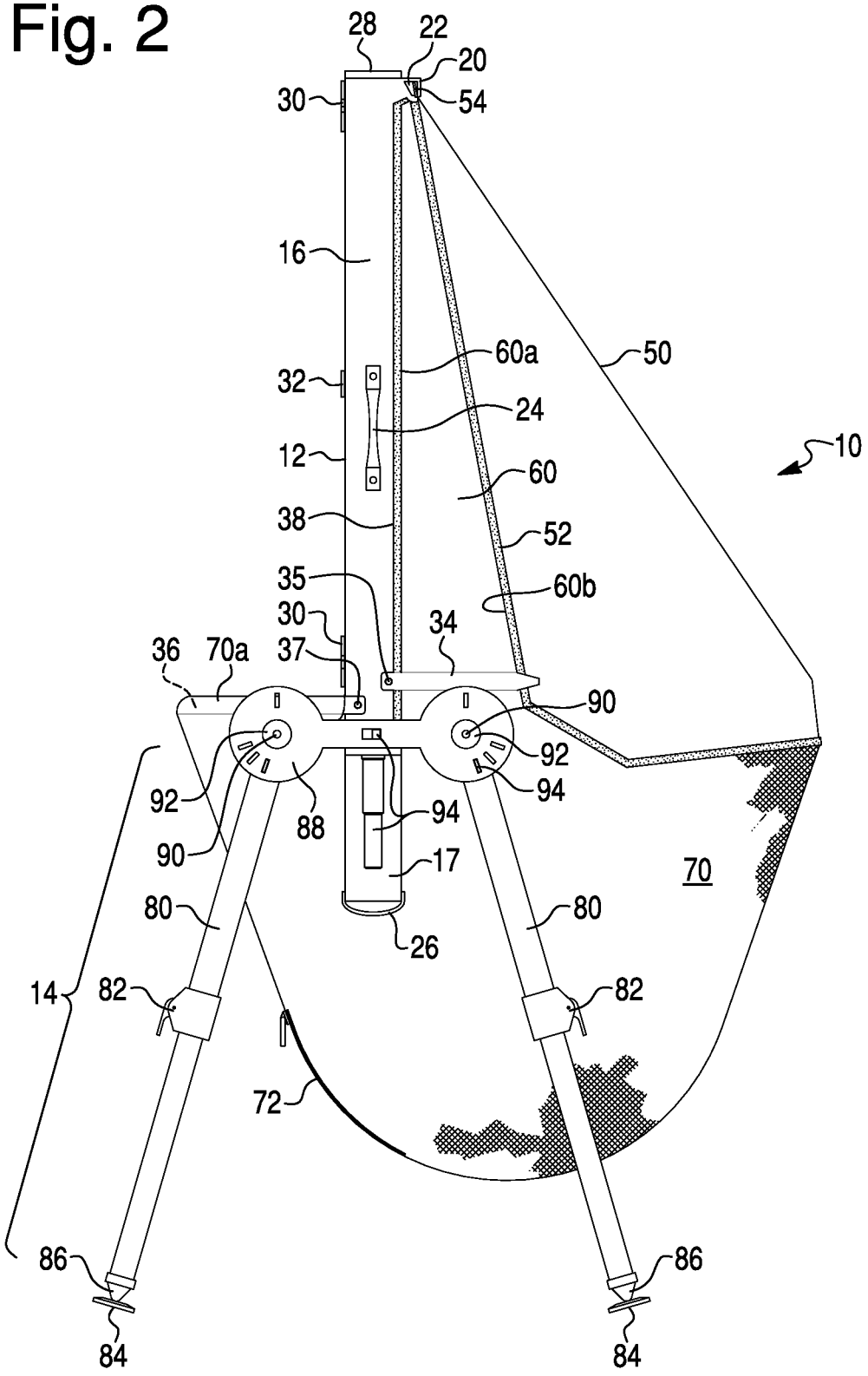
FIG. 2 is a side view of the assembly shown in FIG. 1.

The outer periphery of the target frame 16 is shown in the drawings as rectangular when viewed from the front, for example as best shown in FIG. 1. Legs 17 (FIG. 2) extend downward from the bottom corners of the rectangular portion of the target frame 16. It should be understood that the target frame 16 may have a square, triangular, or other polygonal configuration. Alternatively, a portion or the entirety of the outer periphery of the target frame 16 may be curved, e.g., an arcing portion or possessing a circular or oval shape. As best shown in FIG. 2, the target frame 16 is substantially vertically oriented during use, i.e., when set up for receiving and absorbing incoming Airsoft rounds. The target frame 16 may be designed to utilize full size training silhouette paper targets that average twenty-four by thirty-six inches (24"×36") in size. Smaller or larger size targets and target frames 16 may also be selected, depending upon the intended use of the target trap device 12 and the skill level of the user. For example, larger target frame 16 may be desirable for long distance shooting and for more novice users.

A shield 18 extends along the inner border of the target frame 16. The shield 18 may be sufficiently wide to fill the gap, if any, between the target frame 16 and the target. In the case of a twenty-four by thirty-six inch (24"×36") target frame 16, an exemplary shield 18 is embodied as a 1½" wide strip. The shield 18 may be made of a round absorbing material such as polyethylene, especially low density polyethylene (LDPE), of a thickness of 1/16" or greater. The shield 18 does not need to be removed when the target is replaced.

Figure 3:
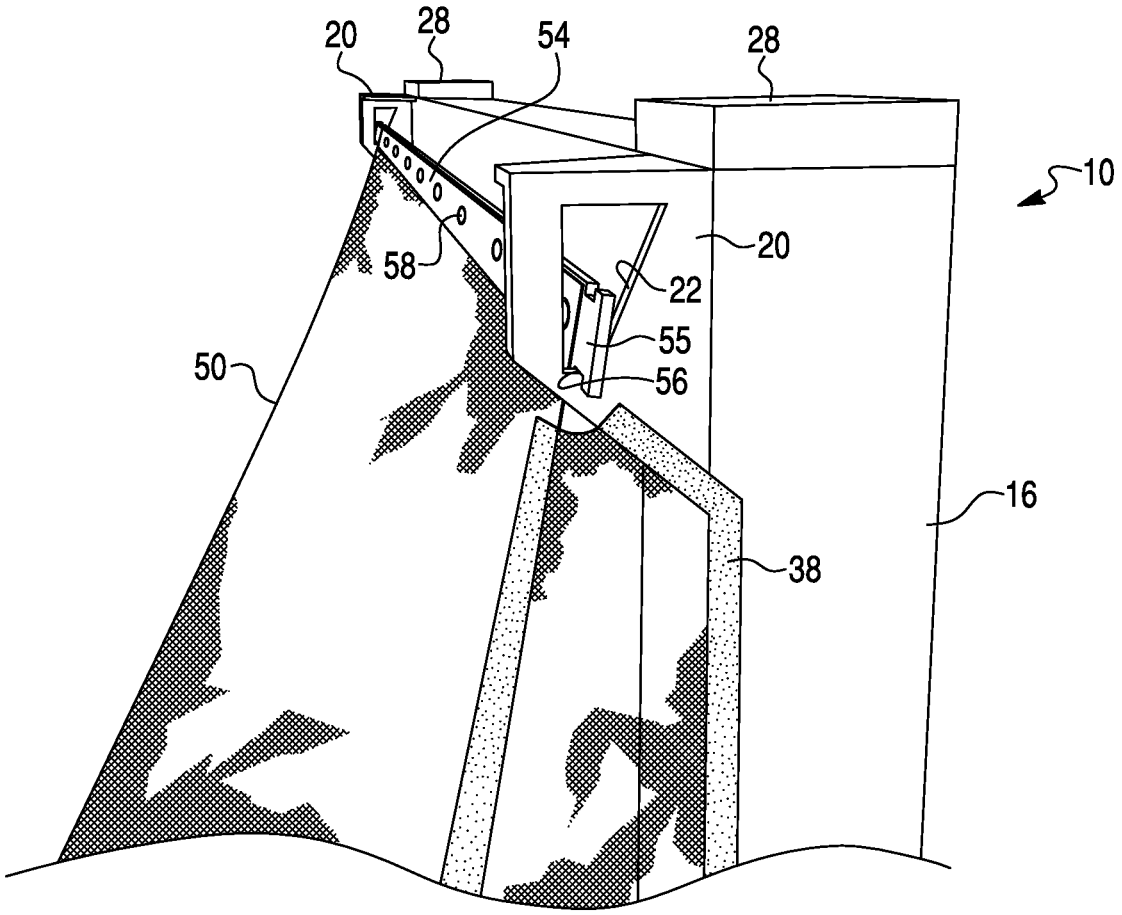
FIG. 3 is a fragmented, side perspective view of the top of the assembly of FIGS. 1 and 2.

As best shown in FIG. 3, support bar brackets 20 are mounted on and extend rearwardly from the upper corners of the back surface of the target frame 16. Conventional fasteners (e.g., screws, bolts, rivets, etc.) and/or adhesive may be used for mounting the support bar brackets 20 to the target frame 16. The support bar brackets 20 may be made of the same material as the target frame 16. The support bar brackets 20 each include a bracket opening 22 configured to receive and permit removal of a backstop mounting bar 54 of a backstop 50. The support bar brackets 20 may protrude, for example, five inches (5") to eight inches (8") rearward from the back surface of the target frame 16, with the bracket opening 22 formed one inch (1") from the rearmost edge of the brackets 20. The bracket opening 22 may be approximately one inch (1") by one-half inch (½"). It should be understood that these and other dimensions exemplified herein are given by way of example, and are not exhaustive of or limiting as to the scope of the invention.

Returning to FIGS. 1 and 2, strap side handles 24 are mounted on opposite sides of the target frame 16. The strap side handles 24 are located approximately at the midpoint of the height of the target frame 16. The strap side handles 24 may be positioned at the center of gravity of the round absorbing Airsoft target trap assembly 10 in its folded state, so that the assembly 10 is balanced when grasped by either of the strap side handles 24. In the interest of comfort, the side strap handles 24 may be approximately one inch (1") in width with a grab area of approximately five inches (5") or more. The primary material of the side strap handles 24 is not particularly limited, with similar performances in functionality of different materials noted. The material can include but is not limited to, for example, heavy duty vinyl, plastic, mil-spec or other heavy duty nylon, polyester, or polypropylene webbing, Cordura®, leather, or some other heavy duty, flexible, long lasting weather resistant material. The type of material ultimately selected for the handles 24 may be determined by cost and durability.

Two bottom strap handles 26, which may be identical in construction to the side strap handles 24, are mounted at the bottoms of the legs 17 of the target frame 16. The bottom strap handles 26 facilitate movement and transport of the round absorbing Airsoft target trap assembly 10 when the assembly 10 is folded into its stowed state and inverted for transportation or storage. Storage feet 28 are located at opposite ends of the top edge of the target frame 16, as shown for example in FIGS. 1 and 2. The storage feet 28 may be made of or padded with a semi-soft material, such as rubber or urethane foam, yet should be sufficiently durable to support the full weight of the assembly 10 when inverted and rested on the storage feet 28. The storage feet 28 may reduce or prevent marring of the target frame 16 during inverted storage and transport.

Target mount fasteners 30, 32 are mounted on the front surface of the target frame 16 for securing a target to the target frame 16 at multiple locations for target practice. Targets are often made of paper, although different materials that allow for penetration of the Airsoft projectile there through may be used. The target mount fasteners 30, 32 are distributed about the perimeter of the target frame 16. In the illustrated embodiment, there are five (5) of the target mount fasteners 30: four of which are positioned at the corners of the target frame 16 and one of which is positioned at the midpoint of the top horizontal frame member of the target frame 16. There are two (2) of the target mount fasteners 32 positioned at the opposite sides of the target frame 16. The target mount fasteners 30 and 32 may be the same or different from one another. Further, arrangements and quantities of target mount fasteners 30, 32 other than shown may be employed. The target mount fasteners 30, 32 each may be a clasp, pin, snap, clip, or other known or useful fastener. Different types of target mount fasteners 30, 32 may be distributed about the target frame 16. For example, the target mount fasteners 30 may be swivable and the target mount fasteners 32 may be slidable (to the left and right in FIG. 1) as to accommodate different size targets and to keep the target taut. Examples of swiveling and sliding target mount fasteners 30, 32 are disclosed in the priority provisional application No. 61/580,247, which is incorporated herein by reference.

In an exemplary embodiment, the target mount fasteners 30, 32 are lightweight metal or plastic material. As with the target frame 16, the target mount fasteners 30, 32 should be resistant to repetitive impacts from Airsoft rounds. In one envisioned embodiment, the target mount fasteners 30, 32 are clips made of stainless steel wire of approximately 3/32"-1/8" diameter, formed into a spring loaded clothesline clip shape. In this embodiment, tension is applied to the paper target by a spring formed in the wire body of the target mount fastener 30, 32. Adjustability of the target mount fasteners 30, 32 is desirable to accommodate use of paper targets smaller than the standard twenty-four by thirty-six inches (24"×36") size. Examples of commercial target mount fasteners that may be used in the assembly 10 are 2¼" long heavy duty chrome multiclips (SKU 46133) available from TAP Plastics.

First and second backstop support guides 34 are positioned on opposite sides of the target frame 16. The backstop support guides 34 are essentially mirror images of one another. Accordingly, the backstop support guide 34 on the right side of the target frame 16, as shown in FIG. 2, will principally be discussed below. The backstop support guides 34 are each pivotally connected to the target frame 16 by a respective hinge 35. In the deployed state shown in FIG. 2, the backstop support guides 34 extend substantially horizontally rearward. In the stowed state shown in FIGS. 6 and 7, the backstop support guides 34 extend substantially vertically along the sides of the target frame 16.

A U-shaped collection bin extension 36 has opposite ends connected the sides of the target frame by hinges 37. The hinges 37 pivotally mount the collection bin extender 36 to the opposite sides of the target frame 16 to permit movement of the collection bin extension 36 between deployed and stowed states. In the deployed state shown in FIG. 2, the collection bin extender 36 extends substantially horizontally forward. In the stowed state shown in FIG. 7, the end portions of the collection bin extender 36 extend substantially vertically along the sides of the target frame 16, and the front portion of the collection bin extender extends in close proximity across the front surface of the target frame 16.

The backstop support guides 34, the U-shaped collection bin extension 36, and the hinges 35 and 37 can be made of for example, a rigid, light weight, weather resistant, and impact resistant material, including but not limited to metal, metal alloys, plastics, composites, and in some cases even possibly wood. The backstop support guides 34, the collection bin extension 36, and the hinges 35, 37 may be made of the same material as the target frame 16. Strength, durability, and light weight may be taken into consideration in selecting construction materials. The backstop support guides 34 may be made of a relatively thin strip material to reduce the chance of being hit by deflected rounds. Yet the backstop support guides 34 should be sufficiently strong to support the weight of the backstop 50 in its proper position (discussed below) for an indefinite amount of time. The hinges 35 and 37 may possess a relatively simple construction, for example, a threaded metal central shaft combined with a thumb screw to facilitate easy manipulation.

A target frame mesh mounting strip 38 is positioned along the outer edge of the target frame 16, extending across the top frame member of the target frame 16 and down the side frame members of the target frame 16 before terminating slightly below the hinges 35 and 37. As shown in FIG. 3, the target frame mesh mounting strip 38 may also extend along the lower edge of the mounting bracket 20. The target frame mesh mounting strip 38 may be a single continuous strip or multiple strips. Additionally, a collection bin mesh mounting strip 40 extends along the bottom front edge of the target frame 16. Adhesive or fasteners may be used to attach the mesh mounting strips 38, 40 to the target frame 16. Each of the mesh mounting strips 38, 40 includes the "hook" portions of hook-and-loop fasteners (e.g., Velcro®) along their lengths. Optionally, the mesh mounting strips 38, 40 may wrap around the edge of the target frame 16 so as to extend about one inch (1") in width along the periphery of the front and/or rear surfaces of the target frame 16.

Accessory mounting holes 48 are formed in the top frame member of the target frame 16, adjacent to the storage feet 28. The accessory mounting holes 48 may be threaded for facilitating the mounting of accessories, such as back lights, signage, storage components, etc.

Figure 5:
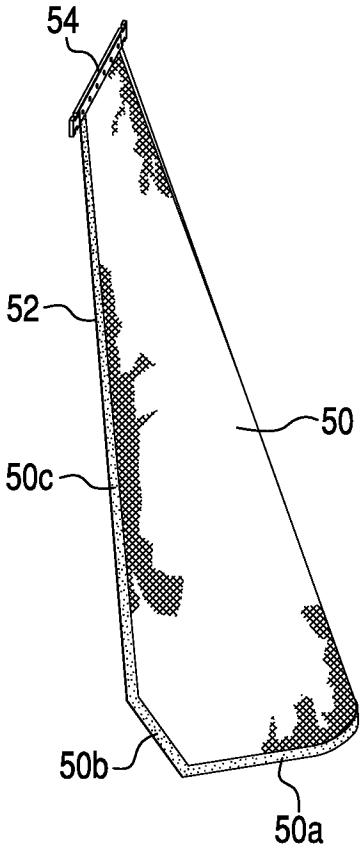
FIG. 5 is a perspective view of the backstop, backstop mesh mounting strip, and backstop mounting bar of FIG. 4.
Figure 4:
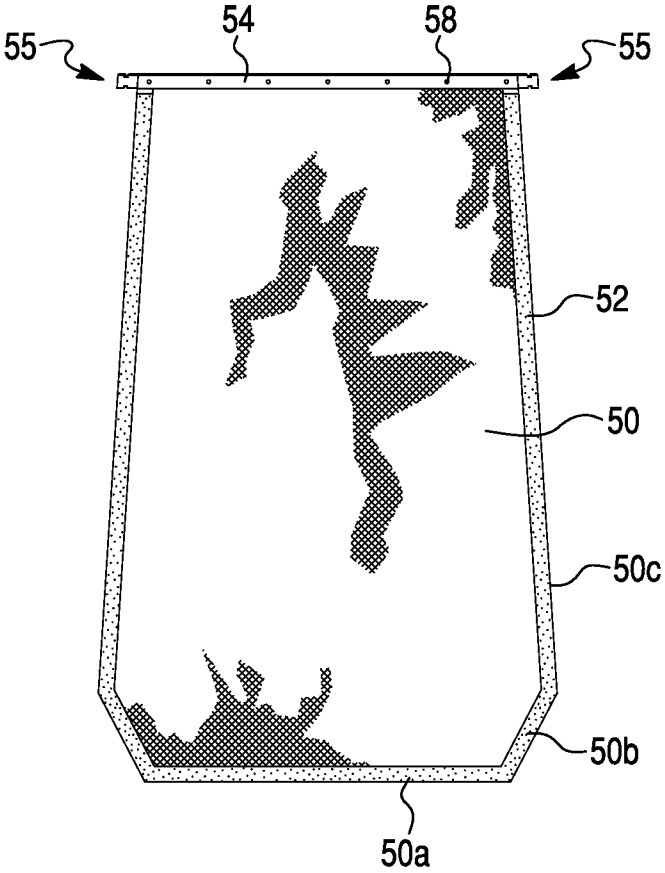
FIG. 4 is a front view of a backstop, backstop mesh mounting strip, and backstop mounting bar of the round absorbing Airsoft target trap assembly of FIGS. 1-3.

The backstop 50 is best shown in FIGS. 4 and 5. In an exemplary embodiment, the backstop 50 is a soft and pliable yet semi-rigid sheet, such as polyethylene, especially low density polyethylene (LDPE). In this exemplary embodiment the backstop 50 is at least ⅛ inch thick and has a density of about 0.910 to about 0.940 g/cm$^3$. The backstop 50 may be made of a single ⅛ inch thick LDPE sheet, or multiple sheets collectively providing a total thickness of ⅛ inch or greater, e.g., two 1/16 inch thick sheets. The ⅛ inch thickness LDPE provides low bounce for preventing incoming Airsoft projectiles from ricocheting out of the assembly 10. A LDPE sheet thickness of at least ⅛ inch is virtually impenetrable to 6 mm and 8 mm Airsoft rounds, even when fired from the highest powered Airsoft guns.

The width of the backstop 50 of the illustrated embodiment is wider than the width of the target frame 16. In a representative embodiment, the backstop 50 is forty-eight inches (48") in height, twenty-five and a half inches (25.5") in width across the top, and forty-eight inches (48") in width across its bottom 50*a*. These dimensions are particularly useful in conjunction with the twenty-four by thirty-six inch (24"×36") target frame 16 discussed above. The backstop 50 of this representative embodiment flares out gradually and substantially uniformly from the top down, reaching a maximum width of approximately fifty-four inches (54") about six inches (6") from the bottom edge 50*a* of the backstop 50 before tapering back to forty-eight inches (48") in width over its bottom six inches (6").

A backstop mesh mounting strip 52 is permanently attached to the perimeter of the backstop 50. The method of attachment may be, for example, those known in the industry, such as tape or adhesive. The adhesive may be, for example, TAP Poly-Weld Adhesive® from TAP Plastics. Backstop mesh mounting strips 52 may be adhered to both the front and rear surfaces of the backstop 50 so that either face of the backstop 50 may be used as the "front" that receives the impact of incoming Airsoft rounds. A benefit to providing the backstop mesh mounting strip 52 on opposite surfaces of the backstop 50 is that after the "front" surface of the backstop 50 has been worn by repeated use, the backstop 50 can be reversed so that the "rear" surface faces forward and serves as the "front" surface to prolong the useful lifespan of the backstop 50. As best shown in FIGS. 4 and 5, the backstop mesh mounting strip (or strips) 52 has a perimeter extending along a bottom edge portion 50*a* of the backstop 50, along sloping edge portions 50*b* that extend upward at an oblique angle from the bottom edge portion 50*a*, and along vertical edge portions 50*c* that extend upward from the sloping edge portions 50*b*.

A plurality of through holes 58, e.g., seven (7), are spaced along the length of the backstop mounting bar 54. Fasteners such as bolt/nut combinations, rivets, etc. are received in the through holes 58 and penetrate the backstop 50 for attaching the top edge of the backstop 50 to the backstop mounting bar 54. Alternatively, claps, quick-release devices, or other fasteners may connect the top of the backstop 50 to the backstop mounting bar 54. The backstop mounting bar 54 is longer than the top edge of the backstop 50, so that overhang portions 55 (FIG. 4) of the backstop mounting bar 54 extend in opposite directions beyond the top edge portion of the backstop 50.

As best shown in FIG. 3, the backstop mounting bar 54 attaches to the support bar brackets 20 as follows. The distance between the bracket openings 22 is the same as the distance between the mounting bar notches 56. The length of the backstop mounting bar 54 is slightly longer than the distance between the bracket openings 22, however, so that the overhang portions 55 of the backstop mounting bar 54 extend in opposite directions through and beyond the bracket openings 22. The mounting bar notches 56 of the backstop mounting bar 54 open downward and are slidingly received in the bracket openings 22. The notches 56 sit in and mate with the portions of the support bar brackets 20 defining the bottom of the bracket opening 22. The mounting bar notches 56 and the bracket openings 22 facilitate securing and centering of the backstop 50 during installation of the target trap device 12. The backstop 50 is suspended from the backstop mounting bar 54 received in the bracket openings 22. The mounting bar 54 is pivotal about its longitudinal axis in the bracket openings 22. The backstop 50 suspended from the mounting bar 54 thereby may be oriented at a predetermined inclination angle $\phi$ (FIG. 8) relative to the target frame 16, which is generally vertically oriented. Because no screws, rivets, or similar fasteners are required for attaching the backstop mounting bar 54 to the target frame 16, the backstop mounting bar 54 may be disengaged and removed quickly and without the need for tools from the support bar brackets 20, for example, when the backstop 50 is worn and needs to be replaced.

The following dimensions are representative and provided by way of example. The backstop mounting bar 54 may be twenty-eight inches (28") in length, ¾" wide and ⅛" in thickness. The mounting bar notches 56 may be ⅛" wide, spaced ⅜" from each end of the backstop mounting bar 54, and cut 5/16" deep from the bottom edge of the backstop mounting bar 54. The backstop mounting bar 54 may be made of a lightweight metal, alloy, plastic, composite, or other material. The selected material should be strong enough to support the weight of the backstop 50.

The round absorbing Airsoft target assembly 10 further includes side mesh panels 60. The side mesh panels 60 extend between the side frame members of the target frame 16 and the vertical edge portions 50*c* of the backstop 50. "Loop" portions of hook-and-loop fasteners extending along the vertical legs 60*a* of the side mesh panels 60 engage the hook portions of the target frame mesh mounting strip 38. Other "loop" portions extending along the angled legs 60*b* of the side mesh panels 60 engage hook portions of the backstop mesh mounting strip 52, as shown for example in FIGS. 2 and 3. The side mesh panels 60 thereby fill the gap between the opposite side frame members of the target frame 16 and the vertical edge portions 50*c* of the backstop 50. The bottom edge of the side mesh panels 60 include "hook" portions for engaging corresponding "loop" portions of a collection bin 70, discussed in further detail below.

The "loop" and "hook" portions along the border of the side mesh panels 60 may be part of a strip, for example a one inch (1") strip, adhered, sewn, or otherwise fastened to the inner surface and/or outer surface of the side mesh panels 60. The hook-and-loop fastening between the side mesh panels 60 and the target frame/backstop mesh mounting strips 38/54 facilitates quick attachment and detachment of the side mesh panels 60. It should be understood that other fasteners, such as zippers, buttons, etc., may be used instead of or to supplement the hook-and-loop fasteners.

A top mesh panel 62 extending along the top of the target frame 16 has loop portions for engaging hook portions of the target frame mesh mounting strip 38 extending across the top edge of the target frame 16. For simplicity sake, the top mesh panel 62 has been omitted from FIG. 3.

Figure 8:
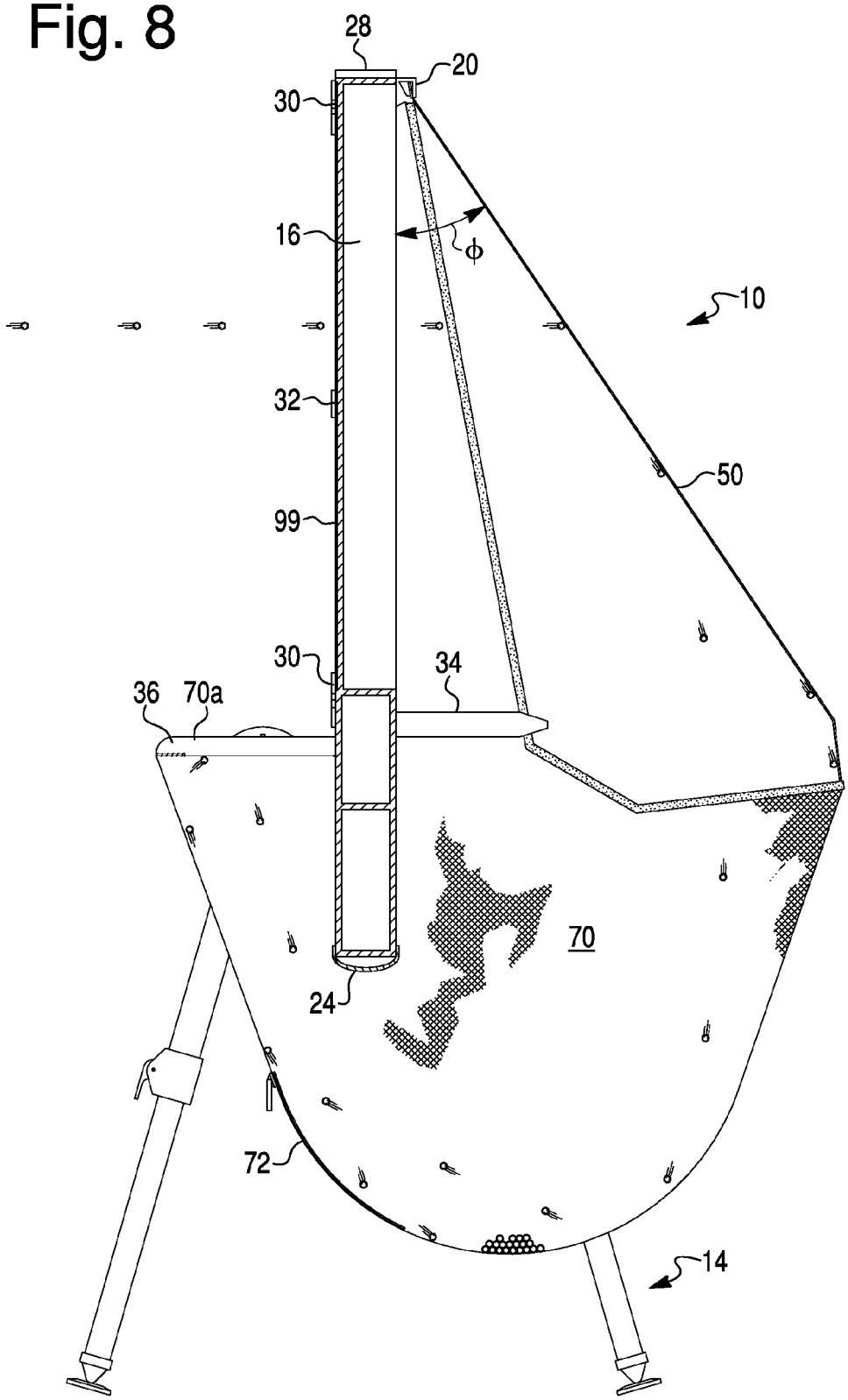
FIG. 8 is a side cross-sectional pictorial representation of Airsoft rounds fired at and captured by the round absorbing Airsoft target trap assembly of the exemplary embodiment of FIGS. 1-3.

As described above, the backstop support guides 34 are pivotal about their respective hinges 35 into substantially horizontal, rearwardly extending deployed positions. In their deployed state, the distal ends of the backstop support guides 34 (i.e., the ends opposite to where the guides 34 are connected to the hinges 35) engage the edges of the backstop 50. The distal ends of the backstop support guides 34 may include slots, insertion points, or other structures or fasteners for engaging the opposite side edges of the backstop 50. For example, FIG. 8 shows the backstop support guides 34 with slotted distal ends that receive the edge of the backstop 50.

The distance between the backstop support guides 34 is shorter than the width of the backstop 50 (in its flattened state) at the point at which the guides 34 engage the backstop 50. (As discussed above, in one envisioned embodiment the width of the backstop 50 at these contact points is about fifty-four inches (54"). The distance between the backstop support guides 34 of the same envisioned embodiment is about 27 inches.) The closeness of the backstop support guides 34 to one another, coupled with the greater width of the backstop 50 where it attaches to the guides 34, cause the backstop 50 to deform under stress.

As best shown in FIG. 5, the central portion of the backstop 50 is deformed into an arcuate shape to provide a concave contact surface against which incoming Airsoft rounds impact. The deformed state of the LDPE backstop 50 causes pressure to be applied laterally to the insides of the support guides 34. This creates tension that works in conjunction with the weight of the backstop 50 keeping the backstop 50 in place inside the slotted end of the support guides 34. The connection, albeit secure, allows for slight rearward movement of the backstop 50 upon impact of the incoming projectiles, further enhancing the LDPE's energy absorbing features. The weight of the backstop 50 works to prevent it from travelling to far back during sustained fire and disconnecting from the support guides 34. The backstop 50 however removes easily from the guides 34 if pulled on its bottom edge in the direction away from the target frame 16. Upon doing so, once the sides of the backstop 50 clear the support guides 34, the LDPE will return to its relatively flat natural state, thus allowing the backstop 50 to lay flat against the back of the target frame 16 or lower base 14. The LDPE of the backstop 50 of the exemplary embodiment is sufficiently resilient and flexible to flex into its desired shape, as shown in FIG. 5, while being semi-rigid so as not to sag like a cloth or fabric.

The length of the backstop support guides 34 (and their positioning) affects the angle of inclination ϕ (FIG. 8) of the backstop 50. The angle of inclination ϕ may be increased by lengthening the backstop support guides 34, and may be reduced by shortening the backstop support guides 34. For example, backstop support guides 34 approximately eight inches (8") in length may be useful with the 24×36" target embodiment discussed herein for providing an angle of inclination ϕ of about thirty-five degrees)(35°). As noted above, the backstop mounting bar 54 received in the bracket openings 22 is pivotal about its longitudinal axis to accommodate different inclination angles ϕ. The angle of inclination ϕ (FIG. 8) of the backstop 50 desirably is in a range of about 30 degrees to about 45 degrees relative to the target frame 16, for example, approximately thirty-five degrees)(35°) from the target frame. In addition to its deflection angle, the concaved shape of the backstop 50 deflects Airsoft rounds incoming at an angular vector or off-center towards the center of the assembly 10 and into a collection bin 70 positioned beneath the target frame 16.

The collection bin 70 serves as a round deceleration chamber. The collection bin 70 may be a bag made of heavy duty mesh netting fabric with small sized mesh holes no more than 3 mm or ⅛" in diameter. The netting may be heavy duty nylon or other material that is lightweight, mold and rot resistant, and durable. Incidentally, the side mesh panels 60 may be made of the same material as the collection bin 70. The collection bin 70 includes a zipper opening 72 at its bottom for facilitating removal of Airsoft rounds from the collection bag 70. A heavy duty YYK zipper assembly is particularly suitable, although other structures (e.g., an access panel) can be used in place of the zipper opening 72 to facilitate removal of the collected Airsoft rounds.

The collection bin 70 contains loop portions of hook-and-loop fasteners along its entire border. The loops may be part of a strip, for example a one inch (1") wide strip sewn or adhered to the collection bin 70.

A forward portion of the collection bin 70 is folded over the U-shaped collection bin extension 36 to form a lip barrier 70*a* that extends substantially horizontally in front of the target frame 16. As best shown in FIG. 8, the lip barrier 70*a* beneath and in front of the target frame 16 establishes a stop panel for deflected Airsoft rounds that have entered the collection bin 70 with sufficient kinetic energy/speed that the rounds "climb" the front portion of the collection bin 70. The fastening loops at the edge of the forward lip barrier 70*a* engage the hook portions of the collection bin mesh mounting strip 40 at the bottom of the target frame 16 to retain the forward lip barrier 70*a* in place.

The bulk of the collection bin 70 is fastened to and hangs below the target frame 16, the side mesh panels 60, and the backstop 50 as follows. The fastening loops along the border of the collection bin 70 engage the hook portions of the mesh mounting strip of the side mesh panel 60 and the backstop mesh mounting strip 62 along the bottom edge portion 50*a* and sloping edge portion 50*b* of the backstop 50.

The support base 14 of the embodiment shown in FIGS. 1, 2, 6 and 7 includes four (4) adjustable support legs 80. The support legs 80 each are made of an upper leg portion 80*a*, and a lower leg portion 80*b* that may be telescopingly received in the upper leg portion 80*a*. Leg height adjustment clamps 82 may be loosened to allow telescoping movement of the lower leg portion 80*b* into and out of the upper leg portion 80*a* to set the height of the support base 14. Tightening the leg height adjustment clamps 82 fixes the upper and lower leg portions 80*a*, 80*b* relative to one another. Alternative height adjustment devices, such as spring-loaded pins for engaging height adjustment holes (not shown) in the support legs 80, may be used. The height of each support leg 80 is individually and separately adjustable. Hence, when the assembly 10 is deployed on an uneven surface, such as a hill, the respective lengths of each support leg 80 may be adjusted to compensate for the topography of the uneven surface and thereby level the assembly 10.

A foot 84 is attached to the bottom end of each leg 80 with a swivel mount 86. Each foot 84 may have a rubber or foam padding for reducing or preventing marring of surfaces on which the round absorbing Airsoft target trap assembly 10 is employed. The swivel mounts 86 can be particularly useful when the round absorbing Airsoft target trap assembly 10 is used on uneven surfaces, such as outside on terrain.

Figure 6:
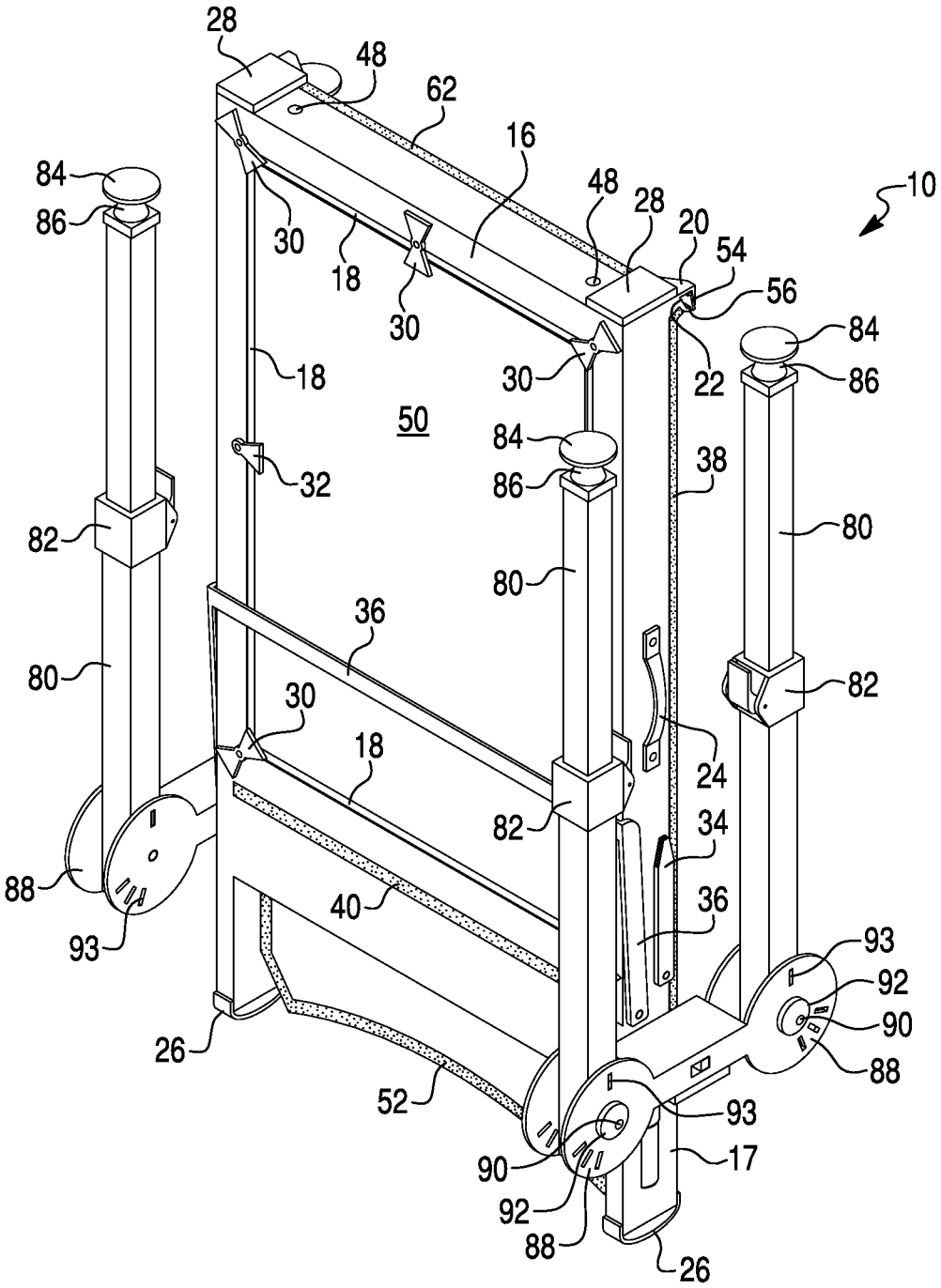
FIG. 6 is a front perspective view of the assembly of FIG. 1 collapsed for storage.
Figure 7:
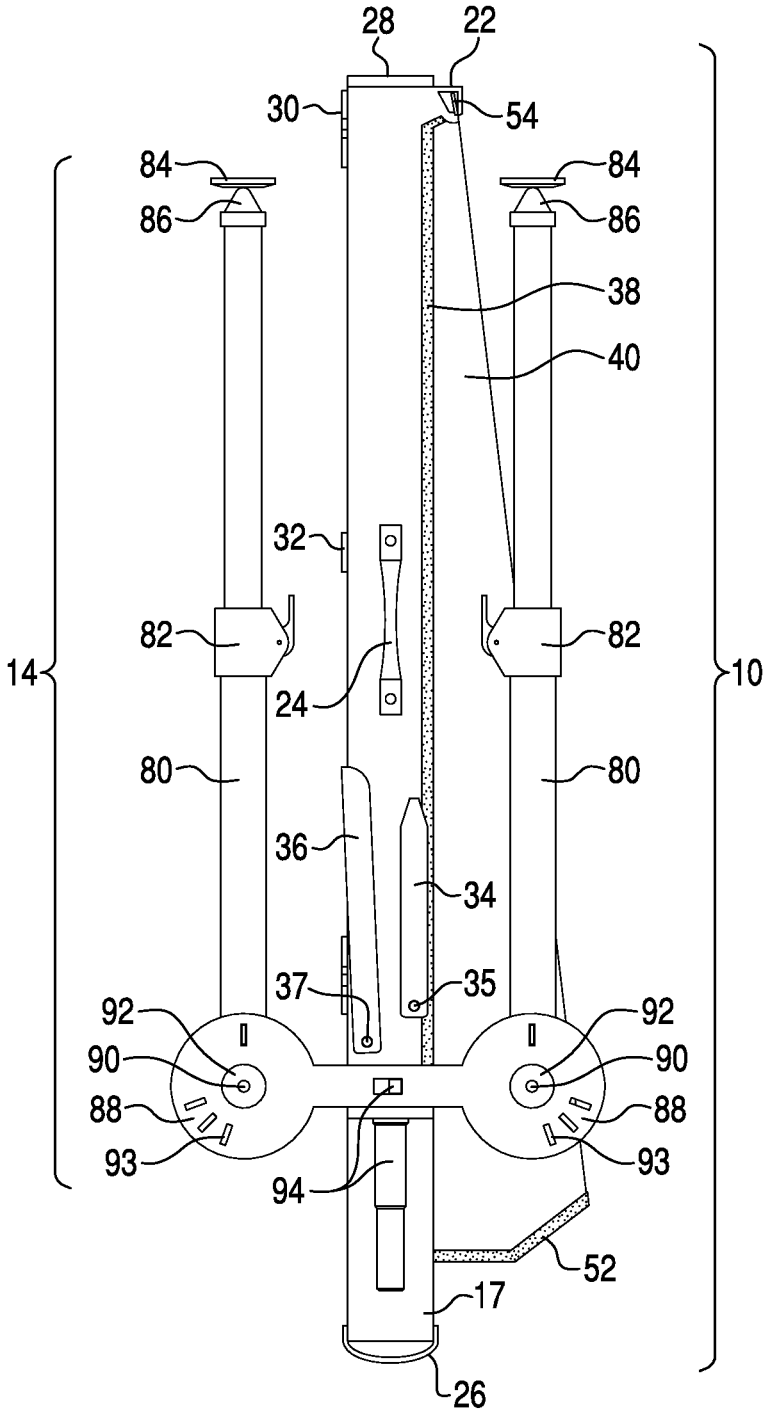
FIG. 7 is a side view of the assembly of FIG. 1 collapsed for storage as in FIG. 6.

The top end of each leg 80 is received between a pair of leg mounting brackets 88 arranged parallel to one another. The top end of each leg 80 has a hole (not shown) through which a shaft 90 is received. The shaft 90 may be, for example, a pin or a bolt. The shaft 90 provides an axis for articulation of the upper leg portion 80*a*. FIGS. 1 and 2 illustrate the legs 80 of the stand 14 in their deployed position, wherein the legs 80 extend downward to establish a support base for the target trap device 12. FIGS. 6 and 7 illustrate the legs 80 of the stand 14 in the folded, stowed position, in which the legs 80 extend adjacent to the target trap device 12. In its stowed state, the assembly 10 may be inverted, transported by grasping onto bottom strap handles 26, and stored by resting the assembly on its storage feet 28. Alternatively, the assembly 10 in its stowed state may be transported by grasping either or both of the strap side handles 24.

Manually adjustable tension knobs 92 are secured by the shaft 90 to the outer face of the outside leg mounting bracket 88. The tension knobs 92 are rotatable to cause the mounting brackets 88 to control the clamping pressure applied to the upper leg portions 80*a*. Rotating the tension knobs in one direction (e.g., clockwise) tightens the clamping pressure, whereas rotating the tension knobs in the opposite direction (e.g., counterclockwise) loosens the clamping pressure. Loosening of the tension knobs 92 permits the legs 80 of the stand 14 to be moved between their extended, deployed state (FIGS. 1 and 2) and their folded, stowed state (FIGS. 6 and 7). Tightening the tension knobs 92 retains the legs 80 in their deployed or stowed state. It should be understood that the tension knobs 92 may be activated/tightened to position the legs 80 at other angles relative to the target trap device 12. The various different positions in which the legs 80 may be secured make the assembly 10 adaptable for use on all different types of terrains and uneven surfaces. Leg adjustment guides 93 formed on or in the leg mounting brackets 88 provide visual indicators to assist in setting the legs 80 at identical angles to one another, as may be particularly desirable when the assembly 10 is deployed on an even surface.

Optionally, a target frame adjuster 94 may be provided for vertical adjustment of the target trap device 12 relative to the stand 14. The target trap device 12, if provided, may include a locking system to secure the selected height of the target trap device 12, and a hydraulic absorber. Alternatively, the hydraulic absorber may be replaced with compression springs.

Advantageously, the stand 14 of the above-described embodiment is constructed so that the round absorbing Airsoft target trap 10 acts as a free-standing, independent device. The different adjustment features (e.g., the telescoping legs 80, the articulation provided by the tension knobs 92, and the swivel mounts 86) of the stand 14 imparts high adaptability, making the target trap device 12 height adjustable for shooting at different elevations (e.g., high and low), adaptable for use on uneven surfaces, and portable for easy stowing and transport.

Figure 9:
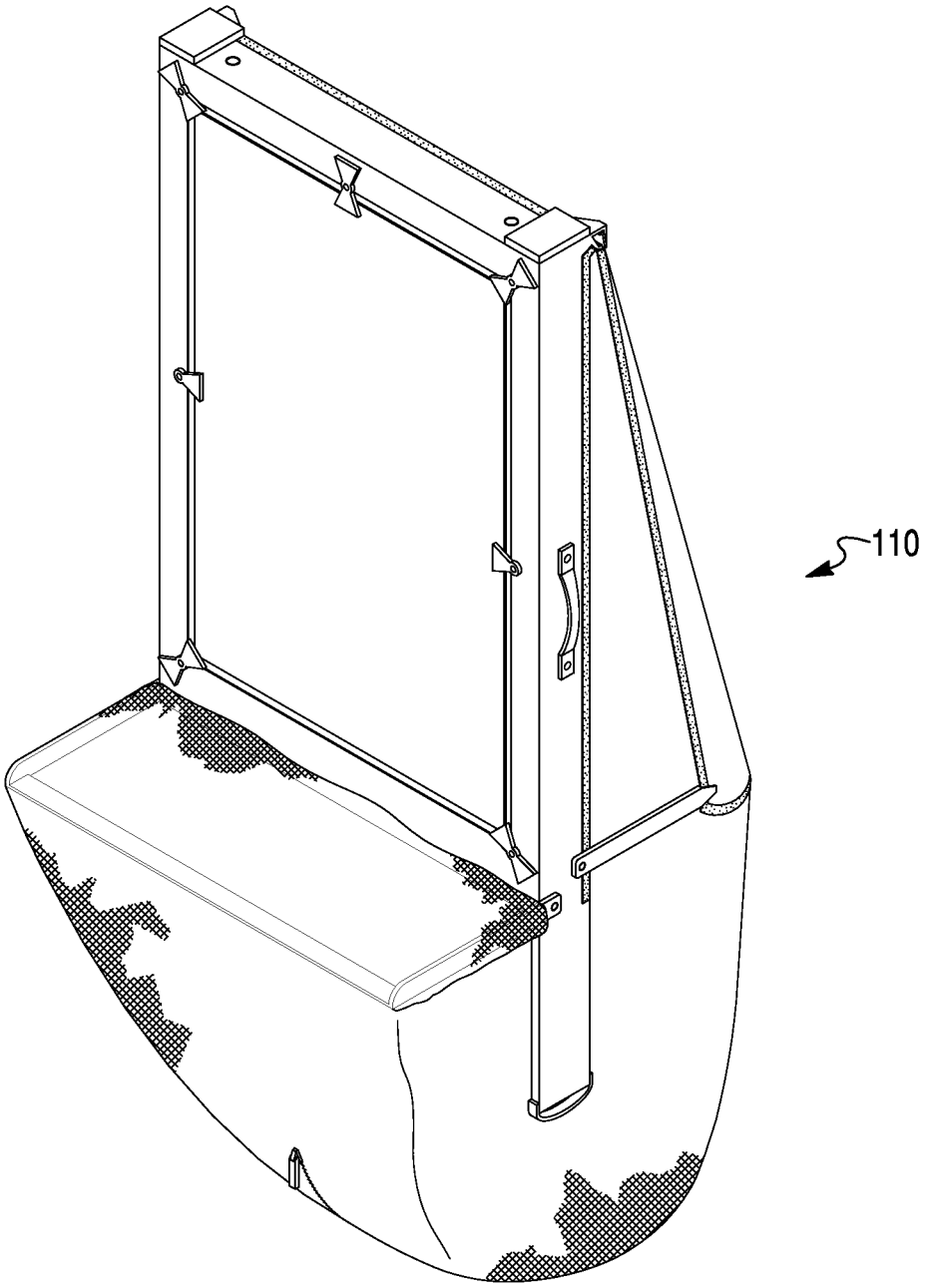
FIG. 9 is a front perspective view of another exemplary embodiment, in which the assembly is shown with short leg configuration designed to be compatible with different base units.
Figure 10:
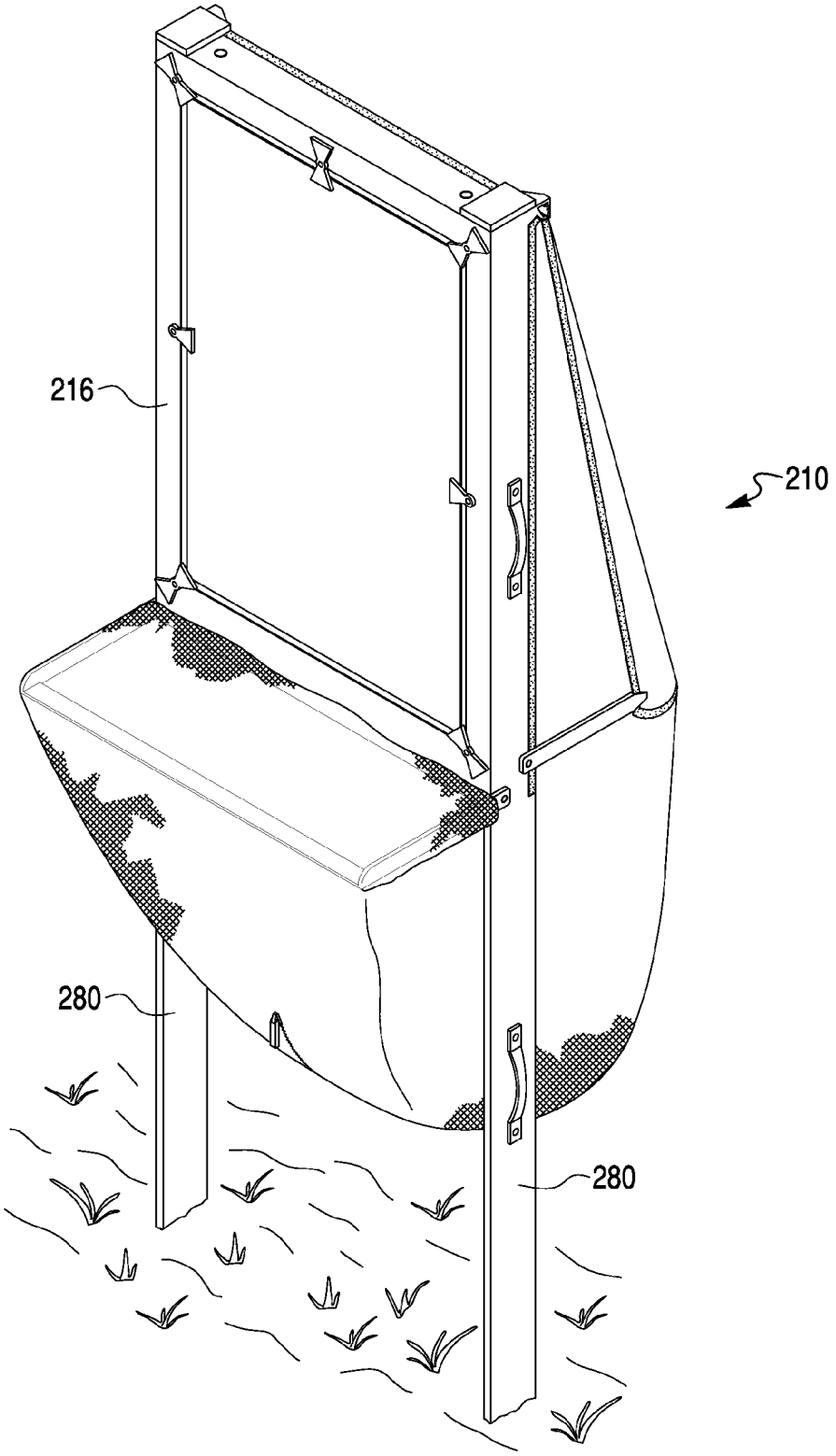
FIG. 10 is a front perspective view of another exemplary embodiment with legs penetrating into the earth.

FIG. 9 illustrates an embodiment of a round absorbing Airsoft target trap 110 without a stand. FIG. 10 illustrates yet another embodiment of a round absorbing Airsoft target trap 210 in which the stand is formed of two parallel legs 280 extending downward from the target frame 216. The legs 280 may be integrally formed with the target frame 216 as a unitary piece or may be separate components attached to the target frame 216. The bottoms of the legs 280 are shown buried into the ground. Optionally, the legs 280 may be stakes with pointed bottoms that can be driven (e.g., hammered) into the ground.

FIG. 8 is a pictorial depiction of the round absorbing Airsoft target trap assembly 10 in use. A target 99 (such as a paper target) is attached to the target frame 16 using target mount fasteners 30 and 32. Airsoft rounds are shot by an Airsoft gun through the target 99. After penetrating through the target 99, the Airsoft round strikes the backstop 50. It has been found by the present inventor that LDPE is particularly resilient, flexible, and impact resistant to effectively reduce the speed of high powered Airsoft rounds without allowing penetration of the rounds through the backstop 50. Multilayer structures, e.g., dual layer LDPE sheets, better resist stretching and deformation that may be caused by prolonged exposure to sustained automatic fire in one area of the backstop 50. LDPE backstops 50 may be sufficiently durable to last thousands of rounds, and once spent can be easily substituted with a replacement backstop. The backstop 50 is set at an angle of inclination $\phi$ selected to deflect high-powered rounds downward towards the collection bin 70, even when the assembly 10 is used without a target 99. Even with the low bounce characteristic of LDPE, high velocity rounds (which may travel over 300 mph, for example) may bounce back through the target frame 16 if the backstop 50 is not set at a proper angle. A ricocheting round may pass back through the target 99, creating a "false" hole in the target that does not reflect the accuracy and precision of the shooter. Additionally, ricocheting rounds present a safety hazard to nearby persons and property.

As shown in FIG. 8, after the incoming round collides with the backstop 50, it decelerates and is redirected into the collection bin 70. As described above, the curvature of the backstop (see FIG. 5) channels the incoming rounds into the collection bin 70. In the illustrated embodiment, the collection bin 70 is hung from the backstop 50, the target frame 16, and the collection bin extension 36. The collection bin 70 is soft and sufficient in volume to serve as a round deceleration chamber. The collection bin 70 of the above exemplary embodiment is made of a mesh fabric bag, although other materials, especially non-rigid fabrics, may be used in addition to or as alternatives for the mesh fabric.

Lower velocity rounds will come to rest at the bottom of the collection bin 70, as shown by the pile of rounds at the bottom of the collection bin 70 of FIG. 8. Higher powered rounds having greater kinetic energy may continue to travel towards and up the front of the collection bin 70, where the rounds will impact the forward lip barrier 70*a* of the collection bin 70 fitted over the U-shaped collection bin extension 36. The forward lip barrier 70*a* of the collection bin 70 prevents the escape of the rounds from the collection bin 70. Rounds reaching the forward lip barrier 70*a* are deflected back to the bottom of the collection bin 70, where the rounds come to rest.

The Airsoft target trap assembly 10 may be used for capturing and collecting rounds from all types of Airsoft weapons. Rounds fired from Airsoft weapons are typically spherical plastic BBs, often 6 mm or 8 mm in diameter and weighting approximately 0.20 grams or more. The assembly 10 may be used with other types of Airsoft rounds and projectiles, including foam balls and rockets fired from "launchers." The target system herein is designed to safely capture and retain all types of projectiles designed for and fired by various Airsoft weapons.

The round absorbing Airsoft target trap assemblies 10, 110, 210 described herein allow the user to allow the user to safely fire an Airsoft gun at a target without the concern of ricochets or of round penetration through the target's backstop. The assemblies do not depend upon the target 99 to stop the incoming projectiles and prevent their ricochet. Hence, the assembly will continue to trap incoming rounds effectively even after the target has been damaged or destroyed by incoming rounds. The assembly 10 allows Airsoft shooters to set up improvised ranges in areas that otherwise would not be suitable due to their surroundings. The assemblies 10, 110, 210 described herein are ideal for use in indoor applications, such as in basements, garages, and small training areas.

According to an embodiment, the round absorbing Airsoft target trap assembly 10 is set up by loosening the tension knobs 92 and unfolding the support legs 80 by rotating each about its respective shaft 90. On a level surface, each leg 80 may be rotated to the same setting as indicated by the leg adjustment guides 93. The tension knobs 92 are tightened to rotationally lock each support leg 80. The leg height adjustment clamps 82 likewise may be loosened to slide the lower leg portion 80*b* telescopingly relative to the upper leg portion 80*a* to set the target frame 16 at the desired height. The leg height adjustment clamps 82 are tightened once the leg height is set. For use of the assembly 10 on uneven surfaces, the height and angle of each leg 80 may be individually adjusted in a trial-and-error manner until the assembly 10 is level and at a desired height. The height may be set so that incoming rounds enter perpendicularly through the target frame 16 along a flight path that is generally perpendicular to the plane in which the target frame 16 is supported.

The backstop 50 is installed by suspending the backstop support bar 54 from the support bar mount brackets 20. The mounting bar notches 56 are received in the bracket openings 22, thereby centering the backstop 50. The backstop support guides 34 are pivoted downward into their deployed position so as to extend rearwards. The collection bin extension 36 also is pivoted downward into its deployed position so as to extend substantially horizontally forward. With the backstop support guides 34 fully deployed and the backstop 50 suspended, the bottom center of the backstop 50 is moved away from the target frame 16. The vertical edge portions 50*c* of the backstop 50 are flexed inwardly as shown in FIG. 5 inserted into the slots of the backstop support guides 34 so as to provide the bottom portion 50*a* with a concave U-shape. The physical resilience of the backstop 50 causes it to retain its curvature while being set at the desired inclination angle $\phi$.

The side mesh panels 60 are then attached as follows. The "loop" portions of hook-and-loop fasteners extending along the vertical legs 60*a* of the side mesh panels 60 are engaged to the hook portions of the target frame mesh mounting strip 38, and the "loop" portions extending along the angled legs 60*b* of the side mesh panels 60 are engaged to the hook portions of the backstop mesh mounting strip 52, as shown for example in FIGS. 2 and 3.

Next, the collection bin 70 is mounted. The forward portion of the collection bin 70 is folded over the U-shaped collection bin extension 36 to establish the lip barrier 70*a*, which extends substantially horizontally in front of the target frame 16. The edge of the lip barrier 70*a* is pulled towards the target frame 16 until the fastening loops at the edge of the forward lip barrier 70*a* engage the hook portions of the collection bin mesh mounting strip 40 at the bottom of the target frame 16. The loop portions of the hook-and-loop fasteners along the border of the collection bin 70 are mated with corresponding "hook" portions of the target mesh mounting strip 38, the bottom edge of the side mesh panels 60, and the backstop mesh mounting strip 52 along the bottom edge portion 50*a* and the sloping edge portions 50*b* of the backstop 50. The mating between the hook and loop portions may be performed by starting on one side of the target frame 16 and working around to the other side, e.g., mating the backstop mesh mounting strip 52 to the target mesh mounting strip 38 on one side of the target frame 16, then to the bottom edge of the side mesh panel 60 on the same side of the assembly 10, then along the sloping edge portion 50*b* of the same side, then around the bottom edge portion 50*a* to the opposite sloping edge portion 50*b*, across the bottom of the opposite side mesh panel 60, then to the target mesh mounting strip 38 on the opposite side of the target frame 16. In this manner, folds in the collection bin 70 and gaps between the mating surfaces may be avoided.

The target 99 is attached to the target mount fasteners 30 and 32 of the target frame 16 to pull the target 99 taut. The assembly 10 is ready for use. The rounds fired at the target 99 pass through the target 99, then are deflected downward by the backstop 50, which absorbs kinetic energy from and slows the incoming round. The backstop 50 is sufficiently soft so as not to break or fragment the rounds, yet is sufficiently impact resistant that the rounds do not embed in or penetrate through the backstop 50. The deflected rounds are received in the collection bin 70. Periodically, the zipper opening 72 is unzipped to remove collected rounds, then zipped back up for further usage.

As mentioned above, the assembly 10 may be folded into a stowed state shown in FIGS. 6 and 7. Tension knobs 92 are each rotated about its respective shaft 90, and support legs 80 are rotated about their respective shafts 90 into the positions shown in FIGS. 6 and 7. The collection bin 70 is disengaged from the collection bin extension 36 and the collection bin mesh mounting strip 40 at the bottom of the target frame 16, and the backstop 50 is disengaged from the backstop support guides 34 prior to folding. However, the backstop 50 and the collection bin 70 do not need be disconnected from one another or removed prior to folding the assembly 10 into its stowed state. That is, the backstop 50 and the collection bin 70 may remain connected to one another, and the backstop 50 may remain connected to the target frame 16 when converting the assembly 10 between its deployed and stowed states.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

Only those claims which use the words "means for" are to be interpreted under 35 USC 112, sixth paragraph. Moreover, no limitations from the specification are to be read into any claims, unless those limitations are expressly included in the claims.

What is claimed is:

1. A round absorbing Airsoft target trap assembly, comprising:

a target frame comprising opposite first and second sides;

a flexible, semi-rigid backstop pivotally connected to the target frame to permit adjustment to an angle of inclination between the backstop and the target frame, the backstop comprising a contact surface facing the target frame and configured to receive an impact of an incoming Airsoft round fired through the target frame; and a backstop support guide that flexes the backstop into an arcuate shape with the contact surface having a concave cross section extending from the first side to the second side of the frame.

2. The round absorbing Airsoft target trap assembly of claim 1, wherein the backstop is pivotally suspended from the target frame.

3. The round absorbing Airsoft target trap assembly of claim 1, wherein the backstop is made of low density polyethylene.

4. The round absorbing Airsoft target trap assembly of claim 1, wherein the backstop support guide is configured to retain the backstop at a selected angle of inclination.

5. The round absorbing Airsoft target trap assembly of claim 4, wherein the selected angle of inclination at which the backstop support guide retains the backstop is approximately 35 degrees.

6. The round absorbing Airsoft target trap assembly of claim 1, further comprising a collection bin positioned below the backstop and the target frame.

7. The round absorbing Airsoft target trap assembly of claim 1, further comprising a support bar bracket mounted to the target frame, and a backstop support bar pivotally connected to the support bar bracket and attached to the backstop.

8. The round absorbing Airsoft target trap assembly of claim 1, wherein the backstop support guide comprises first and second backstop support guides respectively having first and second slots, the first and second slots receiving opposite side edges of the backstop.

9. A round absorbing Airsoft target trap assembly, comprising:

a target frame comprising opposite first and second sides;

a flexible, semi-rigid low density polyethylene backstop comprising a contact surface facing the target frame and positioned to receive Airsoft rounds passing through the target frame; and a backstop support guide that flexes the low density polyethylene backstop into an arcuate shape with the contact surface having a concave cross section extending from the first side to the second side of the frame.

10. The round absorbing Airsoft target trap assembly of claim 9, wherein the low density polyethylene backstop is not penetrable by an Airsoft BB traveling at 500 feet per second.

11. The round absorbing Airsoft target trap assembly of claim 9, wherein the low density polyethylene backstop is arranged at an approximately 35 degree angle of inclination relative to the target frame.

12. The round absorbing Airsoft target trap assembly of claim 9, further comprising a mesh collection bag positioned below the target frame and the low density polyethylene backstop for receiving the Airsoft rounds after the Airsoft rounds have passed through the target frame and collided with the low density polyethylene backstop.

13. The round absorbing Airsoft target trap assembly of claim 9, wherein the backstop support guide comprises first and second backstop support guides respectively having first and second slots, the first and second slots receiving opposite side edges of the backstop.

14. A round absorbing Airsoft target trap assembly, comprising:

a target frame comprising opposite first and second sides;

a flexible, semi-rigid backstop comprising a contact surface facing the target frame and positioned behind of the target frame to receive Airsoft rounds passing through the target frame;

a backstop support guide that flexes the backstop into an arcuate shape with the contact surface having a concave cross section extending from the first side to the second side of the frame; and a collection bin positioned below the target frame and the backstop for receiving the Airsoft rounds after having passed through the target frame and collided with the backstop, the collection bin comprising a forward portion with a substantially horizontally extending lip barrier in front of the target frame.

15. The round absorbing Airsoft target trap assembly of claim 14, wherein the target frame, the backstop, and the collection bin are connected to one another with loop-and-hook fasteners.

16. The round absorbing Airsoft target trap assembly of claim 14, wherein the collection bin comprises a mesh fabric bag, and wherein the backstop comprises low density polyethylene.

17. The round absorbing Airsoft target trap assembly of claim 14, further comprising side mesh panels extending between a rear surface of the target frame and a front edge of the backstop.

18. The round absorbing Airsoft target trap assembly of claim 14, wherein the backstop is pivotally connected to the target frame to permit adjustment to an angle of inclination between the backstop and the target frame.

19. The round absorbing Airsoft target trap assembly of claim 14, further comprising a collection bin extension connected to and extending in front of the target frame, wherein the collection bin comprises a mesh fabric bag folded over the collection bin extension to establish the lip barrier.

20. The round absorbing Airsoft target trap assembly of claim 19, wherein the backstop support guide is connected to and extends behind the target frame.

21. The round absorbing Airsoft target trap assembly of claim 14, wherein the backstop support guide comprises first and second backstop support guides respectively having first and second slots, the first and second slots receiving opposite side edges of the backstop.

* * * * *